United States Patent [19]

Francois-Noël

[11] Patent Number: 4,687,186

[45] Date of Patent: Aug. 18, 1987

[54] GRIPPING DEVICE FOR A WEARING ELEMENT

[75] Inventor: Richard François-Noël, Nancy, France

[73] Assignee: Vesuvius International Corporation, Wilmington, Del.

[21] Appl. No.: 840,266

[22] Filed: Mar. 17, 1986

[30] Foreign Application Priority Data

Mar. 15, 1985 [BE] Belgium ..... 0/214655

[51] Int. Cl.[4] ..... B21D 39/00

[52] U.S. Cl. ..... 266/287; 222/600

[58] Field of Search ..... 266/287, 236, 275, 271; 222/600; 29/515, 516, 517

[56] References Cited

U.S. PATENT DOCUMENTS 4,265,379 5/1981 Meier ..... 222/600

4,508,241 4/1985 Bauer et al. ..... 222/600

4,508,324 4/1985 Lührsen et al. ..... 266/287

*Primary Examiner*—L. Dewayne Rutledge

*Assistant Examiner*—S. Kastler

*Attorney, Agent, or Firm*—Sughrue, Mion, Zinn, Macpeak and Seas

[57] ABSTRACT

The present invention relates to a device for gripping a wearing element of a sliding closure means for metallurgical containers in which the wearing elements are held with gripping in a metal frame by means of rotating members which simultaneously allow the plate to be locked against the frame, the plate to be gripped against the base of the frame and the lateral clearances of the plate in the frame to be absorbed. The gripping devices described are very simple and very robust in design. They contain no screw-threaded parts.

13 Claims, 5 Drawing Figures

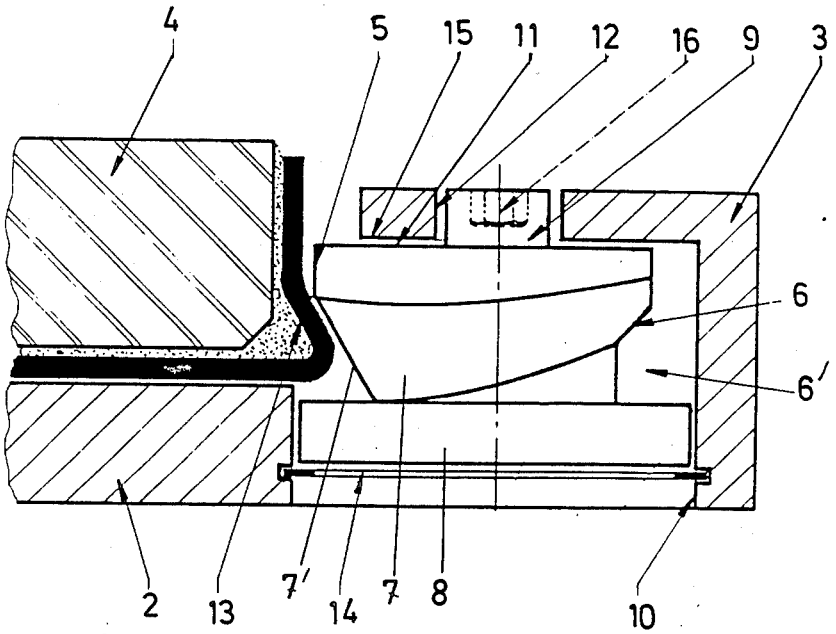
FIG. 2
FIG. 5
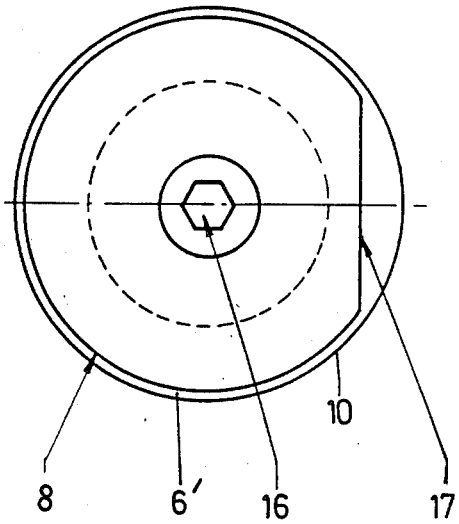

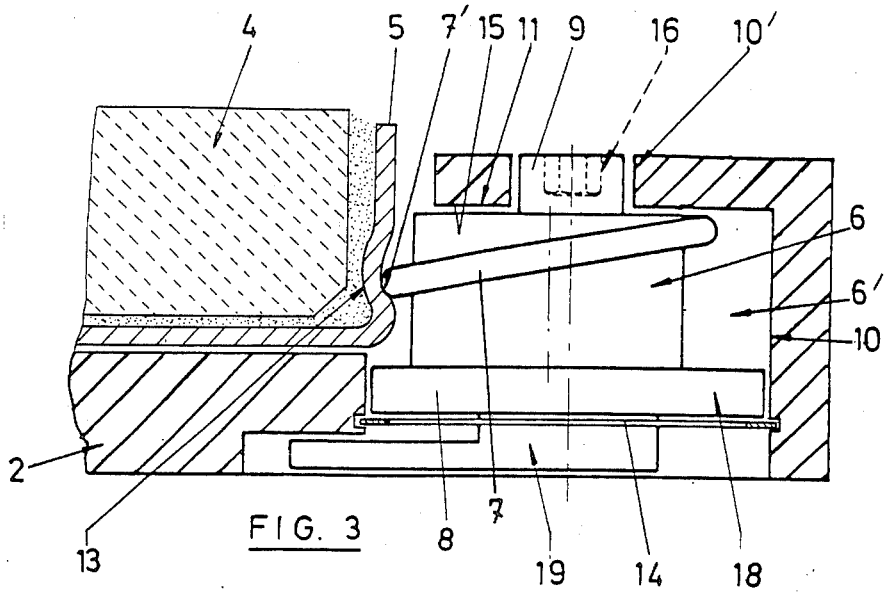
FIG. 3
FIG. 4
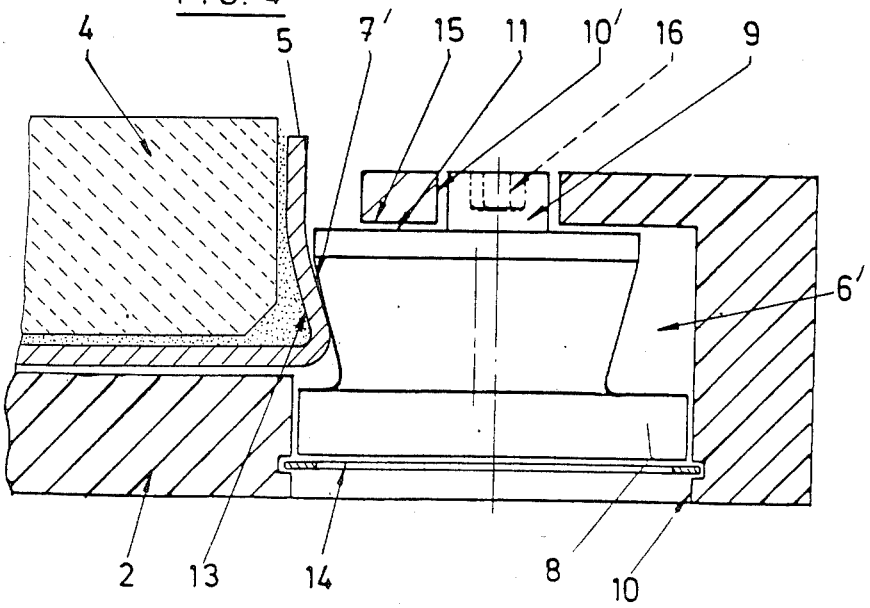

GRIPPING DEVICE FOR A WEARING ELEMENT

The present invention relates to a device for gripping a wearing element of a sliding closure means for a metallurgical container intended for controlling the flow rate of molten metal, composed of a refractory material optionally surrounded by a metal reinforcement, which are mounted in a metal frame equipped with a base wall and lateral abutments against which at least one wearing element rests.

The wearing elements essentially comprise an internal nozzle providing the connection between the metallurgical container and the sliding closure means, a stationary upper plate perforated by at least one oriface facing the internal nozzle, a sliding plate equipped with at least one orifice sliding contiguously against the stationary plate, optionally a lower stationary plate and a collecting nozzle.

These wearing elements are produced from a refractory material surrounded at least in part by a casing forming shuttering. These elements equipped with their metal reinforcement are mounted with gripping in a support frame.

Belgian Pat. No. 876,353 discloses a sliding blocking means for continuous casting in which the base plate which is mounted with gripping by means of at least one cam is capable of exerting on the metallic casing of the base plate gripping stresses orientated both in the longitudinal direction and the transverse direction in order to hold the wearing element in the support frame.

The removal of mechanical clearances parallel to the movement of the moving plate is achieved by gripping the plate. Now, owing to the vibrations and the different coefficients of thermal expansion between the refractory material and the frame, the gripping effect can deteriorate during casting and can even disappear.

As a result, particularly when the sliding closure means is opened, the plate which is thus released falls from its metal frame, thus constituting a source of danger for the operators.

Furthermore, the plates generally have to be placed against a base made in the associated metal frame. The known devices do not allow the plate to be pushed against the base of the frame, this operation being carried out manually or by pressure during sliding closure. This process has the double danger of introducing a human factor and of delaying this positioning action beyond the calcination time of the molten metal providing the joints.

Finally, owing to their design, the existing devices make use of screw-threaded elements which pose problems of disassembly and maintenance under the very difficult thermal operating conditions.

The present invention aims to overcome the disadvantages described above and proposes a device which simultaneously allows the gripping of the plate against the base of the frame, the absorption of the clearances between the plate and the lateral edges and the wedging of the plate within the frame while avoiding the use of screw-threaded elements.

It relates to a sliding closure device for a metallurgical container, in particular a distributor containing a metal bath, essentially characterised in that it is constituted by a rotating member which sets into rotation a cam having an inclined face which pushed back one face of a wearing element while resting on a substantially parallel border of the frame facing the base thereof so as simultaneously to allow the plate optionally equipped with a reinforcement to be pressed against the base of the frame, to allow the plate to be gripped against the lateral edges and the plate to be wedged in the frame.

According to one feature of the invention, the gripping device has two coaxial pivot pins at each end of the central portion of the rotating member forming a cam.

In a particular embodiment of the invention, the device is mounted in a housing defined by the frame, two circular cylindrical orifices which are coaxial on a axis perpendicular to the base of the frame are made in the walls, the large orifice which may be opened on the side facing the base of the frame being intended to receive the large pivot pin for which it acts as a bearing for rotation, the small orifice situated on the opposing side relative to the base of the frame having a diameter which is slightly greater than that of the small pivot pin for which it acts as a rotational bearing, the base wall of the housing perpendicular to the rotational axis of the rotating bolt being defined so as to act as an axial abutment for the face on which the rotating bolt rests.

The cam advantageously has the form of a helix which is coaxial with the pivot pins, a flat part being arranged on the cylinder which generates the helix so as to allow the plate to be introduced into the frame when the flat part is brought opposite the plate.

The preferred form is that of a helix having an axis parallel to the rotational axis of the rotating bolt, the axis of the helix being eccentric relative to the rotational axis of the rotating bolt.

If necessary, the device may comprise several gripping devices distributed over the periphery of the plate.

Further features and details of the invention will appear during the accompanying detailed description of a particular embodiment of the invention, with reference to the following drawings.

FIG. 2 is a sectional view along the section II—II in FIG. 1 so as to show the gripping device according to the invention.

FIG. 3 is a section similar to the one in FIG. 2 of a second embodiment of the gripping device according to the invention.

FIG. 4 is a view similar to those in FIGS. 2 and 3 of a third embodiment of the gripping device.

FIG. 5 shows a rotating member on an enlarged scale.

In the drawings, the same reference numerals designate identical or similar elements.

Figure 1:
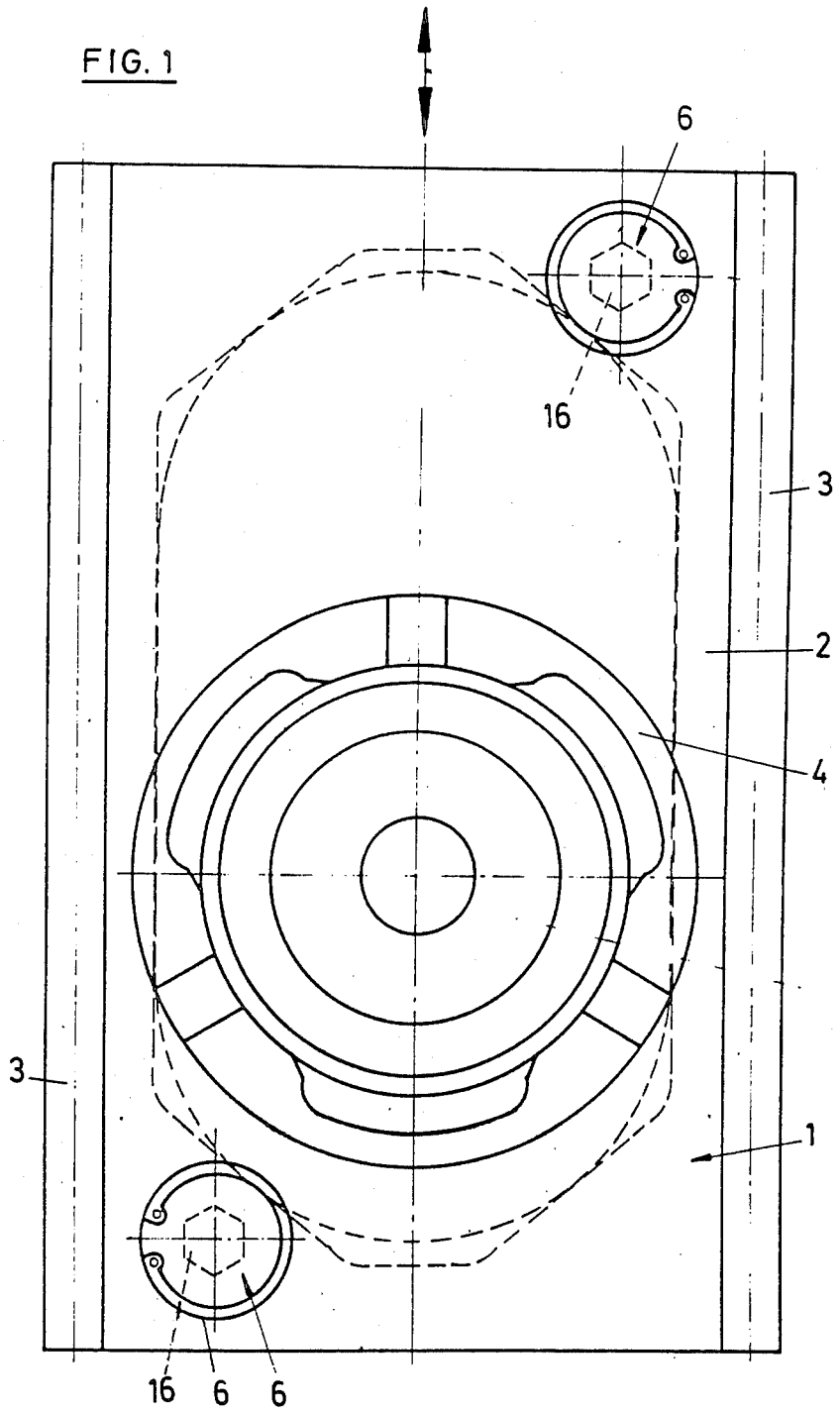
FIG. 1 is a schematic plan view of a sliding closure means.

The schematic plan view in FIG. 1 shows a metal frame designated in its entirity by the reference numeral 1. This frame comprises a base wall 2 and lateral borders 3. It encloses a wearing element 4 of a sliding closure means for a metallurgical container. The wearing element is usually a plate composed of refractory material which may be surrounded by a metal casing 5. The lateral border 3 of the frame 1 is constituted by an angle piece bent at right angles which is intended to reinforce the rigidity of the frame. Cavities intended to receive a respective gripping device 6 are provided in the vicinity of opposing corners.

As shown in FIG. 2, the gripping device 6 comprises a rotating member comprising:

A central portion called a cam 7 having an inclined face 7' facing the base 2 of the frame 1 on either side of the cam 7, and two coaxial pivot pins 8, 9 of different diameters. At the base 2 of the frame 1, a pivot pin 8 having a diameter greater than or equal to the greatest diameter of the cam 7 rests in an orifice 10 provided in the base 2 of the frame 1.

A pivot pin 9 situated on the side opposite the base 2 of the frame 1 has a diameter smaller than or equal to the smallest diameter of the cam 7.

A support face 11 perpendicular to the axis of rotation is made on the back of the cam 7 facing the small pivot pin 9.

The rotating member 6 is thus incorporated in a housing 6' defined by at least one wall 2 of the frame 1 and one border of the lateral walls.

The large orifice 10 is open on the side of the base 2 of the frame 1 and has a diameter which is slightly greater than the diameter of the large pivot pin 8 so as to act as a rotational bearing for it and to allow the rotating bolt 6 to be positioned in the housing 6'. A small orifice 12 situated on the opposite side of the base 2 of the frame 1 in the extension of the first one has a diameter which is slightly greater than the diameter of the small pivot pin 9 so as to act as a rotational bearing for it. The base wall 15 of the housing 6' perpendicular to the axis of rotation acts as a longitudinal abutment for the support face 11 of the rotating bolt 6.

The support surface 13 made in the plate 1 is characterised by the fact that it comprises at least one inclined face turned towards the side of the frame 1 opposite the base 2.

A locking device 14 prevents the rotating member 6 from leaving the housing 8 after it has been positioned while allowing it to rotate. It may be formed by any suitable device such as, for example, the devices known as circlips or cotter pins.

In the operating position, the wearing element constituted by a plate 4 is gripped in the frame 1 by the rotating bolt 6. The sliding closure means thus assumes the form of an assembly of parts which overlap one another and are wedged by a rotating member which locks the plate between the inclined face of the cam 7 and the base 2 of the frame 1. Conversely, the plate 4 wedges the rotating bolt between the parallel inclined face of the support surface 16 of the plate and the base 15 of the housing 6'.

A device of this type prevents the plate from being disconnected from the frame 1, in particular when the sliding closure means is opened, even if the grip is released slightly owing to vibrations or the differential expansion of the different parts. The gripping device is very compact both in thickness and in diameter, allowing it to be housed easily in the existing devices. To achieve the aims of gripping just described, the rotating bolt 6 must exert on the support surface 13 of the plate 1 stresses which are directed simultaneously towards the bottom 2 of the frame 1 and towards the centre of the plate 4.

According to the invention, two effects may be utilised independently or in combination for achieving this result.

According to one variation of the invention illustrated by FIGS. 1 and 3, the cam 7 has the shape of a helix which is coaxial to the pivot pins 8, 9. Rotation of the rotating bolt 3 causes the point where the cam 7 contacts the support surface 13 to move towards the base 12 of the frame in parallel with the axis of rotation of the rotating bolt 6.

The inclination of the contact faces of the cams 7 and support surface 13 guarantees double gripping towards the base 2 of the frame and towards the centre of the plate. A flat part 17 must be provided on the cylinder 18 which generates the helix to allow the plate 1 to be positioned in the frame 2.

The total absence of screw-threads guarantees that, even under the most extreme conditions of operating temperature, the operations of assembly and disassembly will remain easy. The introduction of the rotating bolt 6 through the base 2 of the frame 1 until it strikes the base 15 of the housing 6' prevents the rotating bolt 3 from projecting on the side of the plate 4, even in the case of damage. A projection of this type would cause catastrophic consequences for the parts of the sliding closure means facing the plate 4.

The rotation of the rotating bolt 6 causes the point of contact between the cam 7 and the support surface 13 to travel towards the centre of the plate. The pressing against one another along the inclined contact faces of the cam 7 and the reinforcement 5 guarantees double gripping towards the base 2 of the frame 1 and towards the centre of the plate.

According to a preferred embodiment of the invention illustrated in FIG. 3, the cam 7 has the form of a helix of which the axis is parallel but slightly eccentric to the axis of rotation of the rotating bolt 3.

This device utilises in combination the two effects of helix and of eccentric disc already described.

The new closure device affords significant advantages with respect to robustness, production cost, space required and reliability. In particular, the rotating bolt is solid and may advantageously be produced in a single part from molten metal.

FIG. 1 shows two gripping devices 6 arranged in the frame 2 in a manner which is diametrically opposed to the plate in a direction which is offset by less than 30° relative to the axis of movement of the sliding closure means. Such a device allows the plate 4 to be gripped uniformly against the base 2 of the frame 1.

It is obvious that the invention is not limited exclusively to the modes and forms of production illustrated and that numerous modifications may be made in the form, the arrangement and the constitution of some of the elements used in its production, providing that these modifications are not in contradiction to the object of the following claims.

Thus, the support surface 13 may be made on any other part of the plate 4 and may have various shapes, providing that it has an inclined face turned towards the opposing side of the base 2 of the frame 1.

Instead of and in the place of a device 16 which is preferably arranged in the small pivot pin 9 shaped for the engagement of a tool intended to produce the rotation, a similar device may be provided in the large pivot pin 8, in particular if access from the base side of the frame is more advantageous.

According to one variation of the invention illustrated by way of example in FIG. 3, the large pivot pin 8 is provided with a handle for producing the rotation.

Similar handles may be placed on the small pivot pin 9 provided that they do not interact with the portions facing the plate 4 during manipulation of the sliding closure means.

I claim:

1. A device for gripping a wearing element of a sliding closure means for a metallurgical container and for controlling the flow rate of molten metal, composed of a refractory material surrounded by a metal reinforcement, mounted in a metal frame equipped with a base wall and with lateral abutments against which there rests at least one wearing element, the device comprising a rotatable member for setting into rotation a cam having an inclined face which pushes back a face of a wearing element while resting on a substantially parallel border of the frame facing the base thereof so as simultaneously to allow the plate, equipped with a reinforcement, to be pressed against the base of the frame, to allow the plate to be gripped against the edges and to allow the plate to be wedged in the frame.

2. A device according to claim 1, having two coaxial pivot pins at each end of the central portion of the rotatable member forming a cam.

3. A device according to claim 1, wherein the pivot intended to be arranged in the base of the frame has a diameter at least equal to the greatest eccentricity of the cam.

4. A device according to claim 1, wherein the pivot intended to be arranged on the side opposite the base is at most greater than the smallest eccentricity of the cam.

5. A device according to claim 1, wherein it is mounted in a housing defined by the frame, in the walls of which there are arranged two circular cylindrical orifices which are coaxial on an axis perpendicular to the base of the frame, the large orifice being open on the side of the base of the frame intended to receive the large pivot pin for which it acts as a rotational bearing, the small orifice situated on the opposite side relative to the base of the frame having a diameter which is slightly greater than that of the small pivot pin for which it acts as a bearing for rotation of the base wall of the housing perpendicular to the rotational axis of the rotating bolt being determined so as to act as an axial abutment for the support surface of the rotating bolt.

6. A device according to claim 1, wherein the cam has the form of a helix which is coaxial with the pivot pins, a flat part being provided on the cylinder which generates the helix in order to allow introduction of the plate into the frame when the flat part faces the plate.

7. A device according to claim 2, wherein the cam has the form of a helix with an axis parallel to the axis of rotation of the rotating bolt the axis of the helix being eccentric to the axis of rotation of the rotating bolt.

8. A device according to claim 1, wherein a groove is made in the large orifice of the housing in order to introduce a circlip for locking the rotatable member in the housing.

9. A device according to claim 1, wherein one of the pivot pins at least is shaped for the engagement of a tool intended to produce the rotation of the rotatable member.

10. A device according to claim 1, wherein one of the pivot pins at least comprises a handle intended to produce the rotation.

11. A device according to claim 1, wherein at least two gripping devices are arranged in a manner which is diametrically opposed to the plate in a direction which is offset by less than 30° relative to the axis of movement of the sliding closure means.

12. A device according to claim 1, comprising several gripping devices distributed over the periphery of the plate.

13. A device according to claim 1, wherein the rotatable member is constituted by a monobloc part composed of cast metal.

* * * * *